US010112687B2

(12) United States Patent
Lambrakos et al.

(10) Patent No.: US 10,112,687 B2
(45) Date of Patent: Oct. 30, 2018

(54) SYSTEM AND METHOD FOR CONVERSION OF FLOATING DRILLING PLATFORM TO FLOATING PRODUCTION PLATFORM

(71) Applicant: TECHNIP FRANCE, Courbevoie (FR)

(72) Inventors: Kostas F. Lambrakos, Houston, TX (US); Chenteh Alan Yu, Houston, TX (US); Johyun Kyoung, Katy, TX (US); Djoni Eka Sidarta, Houston, TX (US)

(73) Assignee: TECHNIP FRANCE, Courbevoie (FR)

( * ) Notice: Subject to any disclaimer, the term of this patent is extended or adjusted under 35 U.S.C. 154(b) by 0 days.

(21) Appl. No.: 15/189,217

(22) Filed: Jun. 22, 2016

(65) Prior Publication Data

US 2017/0369133 A1 Dec. 28, 2017

(51) Int. Cl.
*B63B 35/44* (2006.01)
*E21B 19/00* (2006.01)

(52) U.S. Cl.
CPC ..... *B63B 35/44* (2013.01); *B63B 35/4413* (2013.01); *E21B 19/004* (2013.01); *B63B 2035/448* (2013.01)

(58) Field of Classification Search
CPC combination set(s) only.
See application file for complete search history.

(56) References Cited

U.S. PATENT DOCUMENTS 5,135,327 A 8/1992 White et al.
5,439,321 A 8/1995 Hunter
5,865,566 A 2/1999 Finn
6,375,391 B1 * 4/2002 Børseth ..... E21B 19/004 114/264
7,537,416 B2 * 5/2009 Wetch ..... B63B 35/4413 166/350
2001/0000718 A1 5/2001 Blevins
2008/0041292 A1 * 2/2008 Sablok ..... B63B 1/048 114/264

FOREIGN PATENT DOCUMENTS

GB 2023205 12/1979
WO WO-2015028611 A1 * 3/2015 ..... B63B 1/107

OTHER PUBLICATIONS

International Search Report and Written Opinion for International Application No. PCT/US2017/038339 from the European Patent Office, dated Oct. 16, 2017, 14 pages.

* cited by examiner

*Primary Examiner* — Kyle Armstrong
(74) *Attorney, Agent, or Firm* — Jackson Walker, LLP

(57) ABSTRACT

The present disclosure provides a system and a method for efficiently converting the structure of a drilling floating platform into a structure for a production floating platform. A riser support module can be coupled to a topsides of the drilling floating platform and suspended below a moonpool or other opening through the topsides to support risers and their respective riser pull tubes, if any. The riser support module can be prebuilt and installed as a unit for example at a quayside.

17 Claims, 17 Drawing Sheets

SYSTEM AND METHOD FOR CONVERSION OF FLOATING DRILLING PLATFORM TO FLOATING PRODUCTION PLATFORM

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The disclosure generally relates to floating platforms for hydrocarbon drilling and production. More specifically, the disclosure relates to conversion of floating platforms used generally for drilling operations to floating platforms generally used for production operations.

Description of the Related Art

One method of characterizing floating offshore platforms for hydrocarbon operations is by their function in the hydrocarbon process. One primary function is drilling for the hydrocarbons. FIG. 1A is a schematic side view of an exemplary drilling floating platform. FIG. 1B is a schematic cross-sectional view showing the structure of FIG. 1A below the top superstructure. A drilling floating platform 2, sometimes known as a Mobile Offshore Drilling Unit ("MODU"), generally includes a topsides 4 positioned above at least three columns. The columns are generally supported by at least two pontoons 8. The floating platform 2 generally has an open space 12 between the pontoons to allow for drilling operations below the topsides 4. A relatively small moonpool 14 is formed through the topsides 4 to allow drilling equipment from the derrick 10 to pass through the topsides and through the open space 12 into the water below for the drilling operations. Thus, a drilling floating platform 2 can be characterized by having little, if any, substructure directly below the moonpool 14.

A subsequent function is producing the hydrocarbons after the drilling floating platform has drilled a hydrocarbon well. FIG. 2A is a schematic top perspective view of an exemplary production floating platform. FIG. 2B is a schematic top perspective cross-sectional view of the production floating platform of FIG. 2A below the top superstructure. The production floating platform 22 generally includes a topsides 24 to support production equipment (not shown) that is supported by a plurality of columns 26, which in turn are coupled with a plurality of pontoons 28. Various structures 30 are generally formed across the space between the pontoons below the topsides to support a riser guide plate 32, riser pull tube guides 34 for risers (not shown) that can extend up from the seafloor, and other equipment used for the production operations.

A variant of a typical floating production platform is shown in U.S. Pat. No. 5,439,321. FIG. 3A is a schematic side view of an exemplary semisubmersible floating platform with a tension leg wellhead platform. FIG. 3B is a schematic perspective view of the wellhead platform of the exemplary platform of FIG. 3A. The system includes a semisubmersible production floating platform 42 with a working deck 44 with a drilling rig 50, columns 46, and buoyancy chambers 48. A "small, low, free-board production riser support unit" acts as a "small tension leg wellhead platform (TLWP)" (col. 8, lines 23-44) with positive buoyancy that pulls tension on the risers connected to wellhead equipment 56 on the TLWP upper deck and is independently and flexibly moored to the floating platform 42. In advance of extreme environments, the operator can move the floating platform 42 and leave the TLWP 54 to maintain tension on the risers.

Because of the different functions of the platforms, different platforms are traditionally used for each of the purposes. The platforms are built according to the needs of each function. Thus, an expenditure of hundreds of millions of dollars is required to have the two different types of platforms. A technical challenge to date has been using the floating drilling platform with its non-existent substructure below the moonpool for a production floating platform typically of a semisubmersible design. In some instances, it is desirable to convert the drilling floating platform into a production floating platform. The challenge has been how to efficiently convert the drilling platform into the production platform.

Therefore, there remains a need for a system and method of converting the drilling floating platform into the production floating platform.

BRIEF SUMMARY OF THE INVENTION

The present disclosure provides a system and a method for efficiently converting the structure of a drilling floating platform into a structure for a production floating platform. A riser support module can be coupled to a topsides of the drilling floating platform and suspended below a moonpool or other opening through the topsides to support risers and their respective riser pull tubes, if any. The riser support module can be prebuilt and installed as a unit for example at a quayside. The riser support module is intended to minimize changes to the drilling floating platform for conversion to a production floating platform, lessen offshore construction work, and reduce the need for dry docking for an extended time of the floating platform for installation of the riser support module.

The disclosure provides a system of conversion of an offshore floating platform, comprising an offshore floating platform having a topsides having a moonpool formed therethrough; at least three columns coupled to the topsides, the columns extending above a water level and below the water level during operations; and at least two pontoons coupled to the columns, the pontoons having buoyancy and extending at least partially below the water level. The system further comprises a riser support module suspended below the topsides and fixedly coupled to the topsides, the module being non-water tight and configured to support at least one riser that extends through the riser support module.

The disclosure provides a method of converting a drilling floating platform to a production floating platform, comprising: accessing a drilling platform having a topsides with a moonpool formed therethrough, a topsides having a moonpool formed therethrough; at least three columns coupled to the topsides, the columns extending above a water level and below the water level during operations; and at least two pontoons coupled to the columns, the pontoons having buoyancy and extending at least partially below the water level; and fixedly coupling a riser support module to the topsides to suspend below the moonpool, the module being non-water tight and configured to support at least one riser that extends through the riser support module.

The disclosure further provides a system for hydrocarbon production, comprising: an offshore floating platform having a topsides having a moonpool formed therethrough; at least three columns coupled to the topsides, the columns extending above a water level and below the water level during operations; and at least two pontoons coupled to the columns, the pontoons having buoyancy and extending at least partially below the water level; and a riser support module suspended below the topsides and fixedly coupled to the topsides, the module being non-water tight and configured to support at least one riser that extends through the riser support module.

DETAILED DESCRIPTION

Figure 1A:
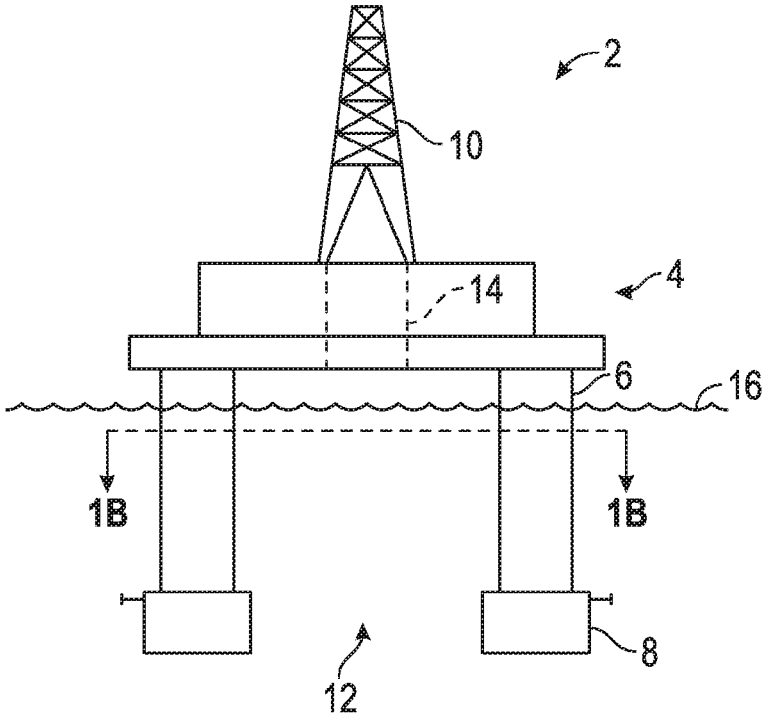
FIG. 1A (Prior Art)
FIG. 1A is a schematic side view of an exemplary drilling floating platform.
Figure 1B:
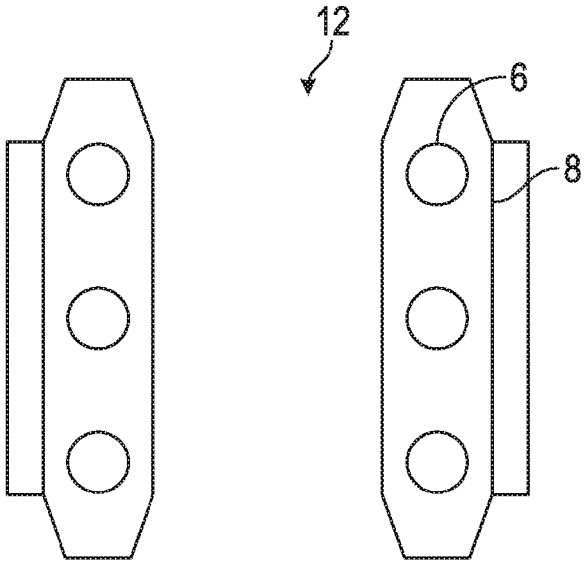
FIG. 1B (Prior Art)
FIG. 1B is a schematic cross-sectional view showing the structure of FIG. 1A below the top superstructure.
Figure 2A:
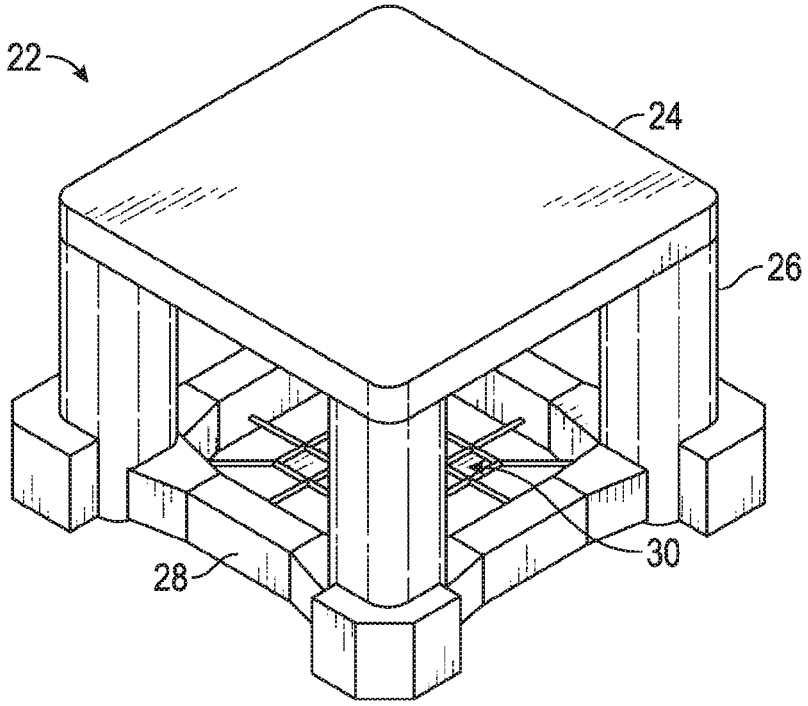
FIG. 2A (Prior Art)
FIG. 2A is a schematic top perspective view of an exemplary production floating platform.
Figure 2B:
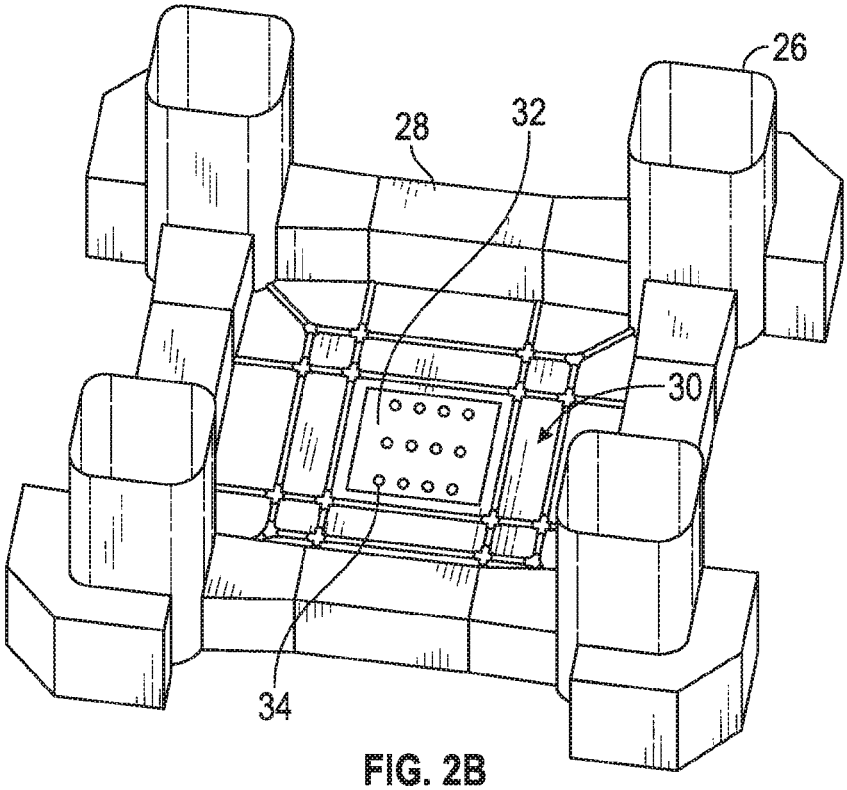
FIG. 2B (Prior Art)
FIG. 2B is a schematic top perspective cross-sectional view of the production floating platform of FIG. 2A below the top superstructure.
Figure 3A:
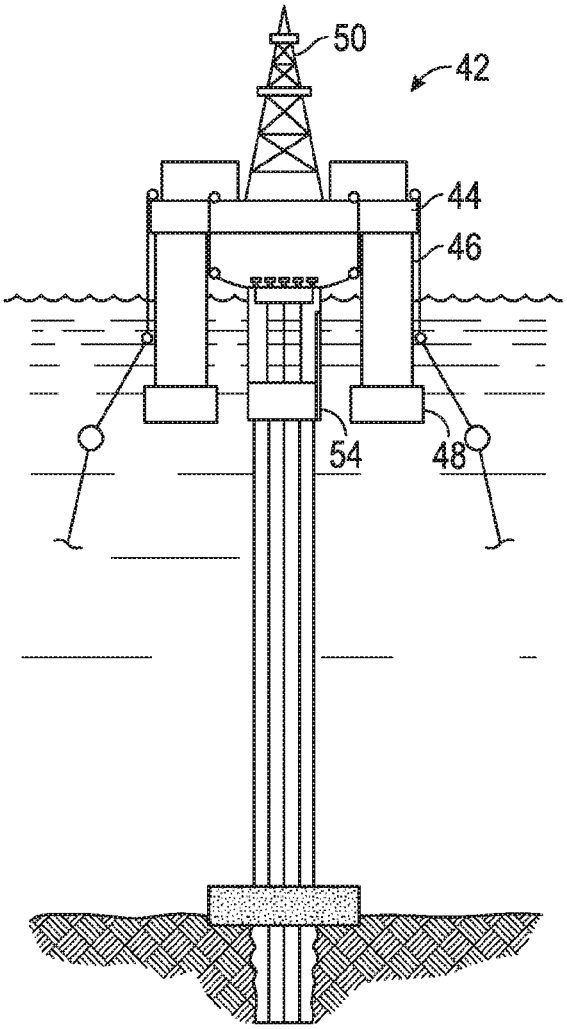
FIG. 3A (Prior Art)
FIG. 3A is a schematic side view of an exemplary semisubmersible floating platform with a tension leg wellhead platform.
Figure 3B:
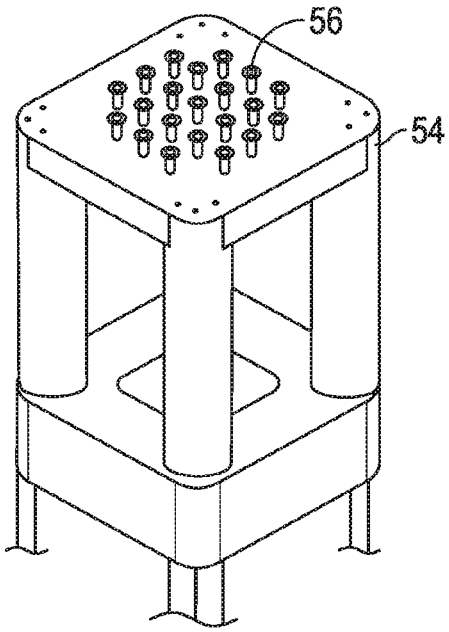
FIG. 3B (Prior Art)
FIG. 3B is a schematic perspective view of the wellhead platform of the exemplary platform of FIG. 3A.

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Further, the various methods and embodiments of the system can be included in combination with each other to produce variations of the disclosed methods and embodiments. Discussion of singular elements can include plural elements and vice-versa. References to at least one item may include one or more items. Also, various aspects of the embodiments could be used in conjunction with each other to accomplish the understood goals of the disclosure. Unless the context requires otherwise, the term "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The order of steps can occur in a variety of sequences unless otherwise specifically limited. The various steps described herein can be combined with other steps, interlineated with the stated steps, and/or split into multiple steps. Some elements are nominated by a device name for simplicity and would be understood to include a system or a section, such as a "valve" would encompass a control mechanism or system to operate the valve, and so forth. Other and further embodiments utilizing one or more aspects of the invention described herein can be devised without departing from the spirit of Applicant's invention. For example, various combinations of the embodiments and other embodiments can be made, various relative sizes of the riser support module and any portions thereof can vary, the number of portions of the riser support module can vary, the number and placement of risers and/or riser pull tubes can vary, the manner of supporting the risers can vary, the manner of coupling of the riser support module with the topsides can vary, and other variations can occur in keeping within the scope of the claims.

The present disclosure provides a system and a method for efficiently converting the structure of a drilling floating platform into a structure for a production floating platform. A riser support module can be coupled to a topsides of the drilling floating platform and suspended below a moonpool or other opening through the topsides to support risers and their respective riser pull tubes, if any. The riser support module can be prebuilt and installed as a unit for example at a quayside. The riser support module is intended to minimize changes to the drilling floating platform for conversion to a production floating platform, lessen offshore construction work, and reduce the need for dry docking for an extended time of the floating platform for installation of the riser support module.

Figure 4A:
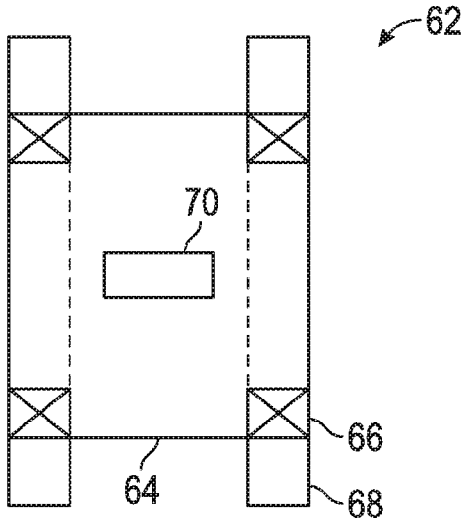
FIG. 4A is a schematic top view of an exemplary embodiment of a converted drilling floating platform into a production floating platform.
Figure 4B:
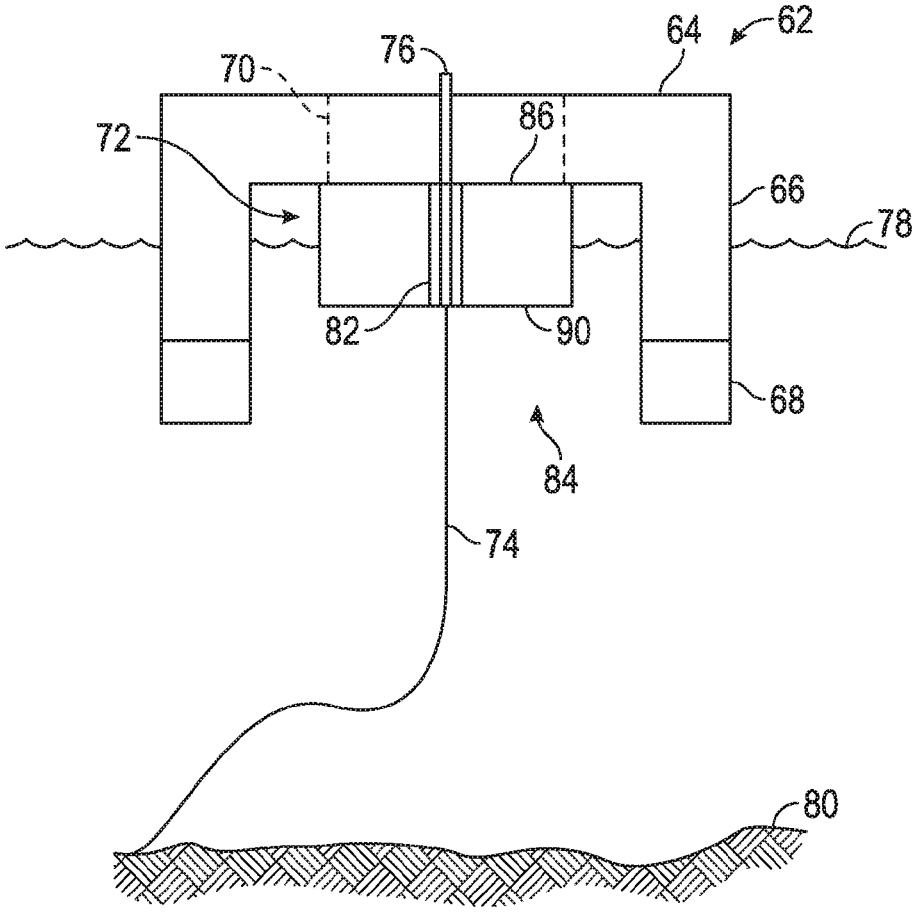
FIG. 4B is a schematic end view of the exemplary converted platform of FIG. 4A.

FIG. 4A is a schematic top view of an exemplary embodiment of a converted drilling floating platform into a production floating platform. FIG. 4B is a schematic end view of the exemplary converted platform of FIG. 4A. A converted drilling floating platform 62 includes a topsides 64 that are supported by at least three columns 66. The columns 66 are supported by at least two pontoons 68. A moonpool 70 is formed through the topsides 64 generally in a centralized location, although the location can vary. The moonpool cross-sectional area across the moonpool is relatively small compared to the topsides cross-sectional area across the topsides, and traditionally a derrick as a drilling rig (not shown) is positioned over the moonpool for drilling operations. A riser support module 72 is installed to the platform 62 and fixedly coupled thereto.

In the embodiment shown, the riser support module 72 can be installed and suspended from the topsides. In general, the riser support module is a non-floating structure, that is, the module is not sealed in a manner that provides additional buoyancy to the platform. The riser support module 72 thus extends into the open space 84 formed below the topsides 64 between the pontoons 68. The riser support module 72 can provide support to risers passing therethrough in a manner that would otherwise be absent from a drilling platform. The riser support module can terminate below the topsides 64 but above the water level 78, terminate in the water column below the water level but above the pontoons 68, or terminate in the water column below the pontoons. Further, the riser support module 72 can be of various sizes in cross-sectional area, as may be appropriate for a given circumstance and design. As will be described herein, some riser support modules can be water resistant from side-to-side to form a shell around at least one riser disposed therein. Such a riser support modules can be least partially open (non-water tight, that is, at least partially open to fluids entering an internal volume of the module) at the bottom and/or top, while other riser support modules can be more transparent to water from a side-to-side direction by using principally frame members, such as trusses and such framing structures. For purposes herein, the term "top" is broadly defined to include from about midway along the height of the riser support module to the upper limit of the riser support module, and the term "bottom" is broadly defined to include from about midway along the height of the riser support module below the top to the lower limit of the riser support module. The riser support module 72 can further include one or more riser openings 82 through which one or more risers 74 can be disposed to extend downward toward the seabed 80. The riser openings 82 can be formed through specific openings in a support structure, such as a support plate across the riser support module, or through spaces formed between intersecting frame members across the riser support module, or through spaces in a generally open bottom with risers being supported around a periphery of the riser support module 72. Thus, depending on the amount of structure, the riser support module can have varying degrees of transparency to water passing therethrough.

Figure 5:
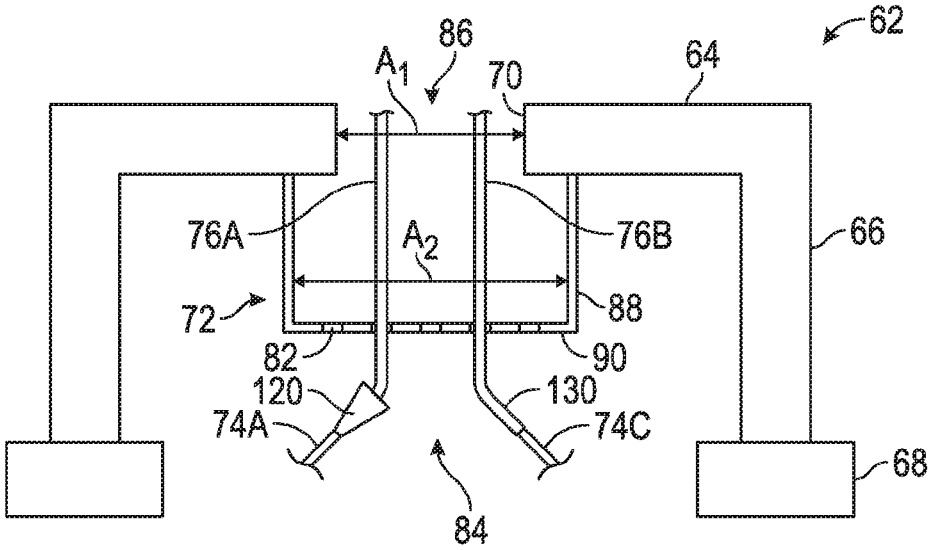
FIG. 5 is a schematic side view of another exemplary embodiment of a converted floating platform.
Figure 6:
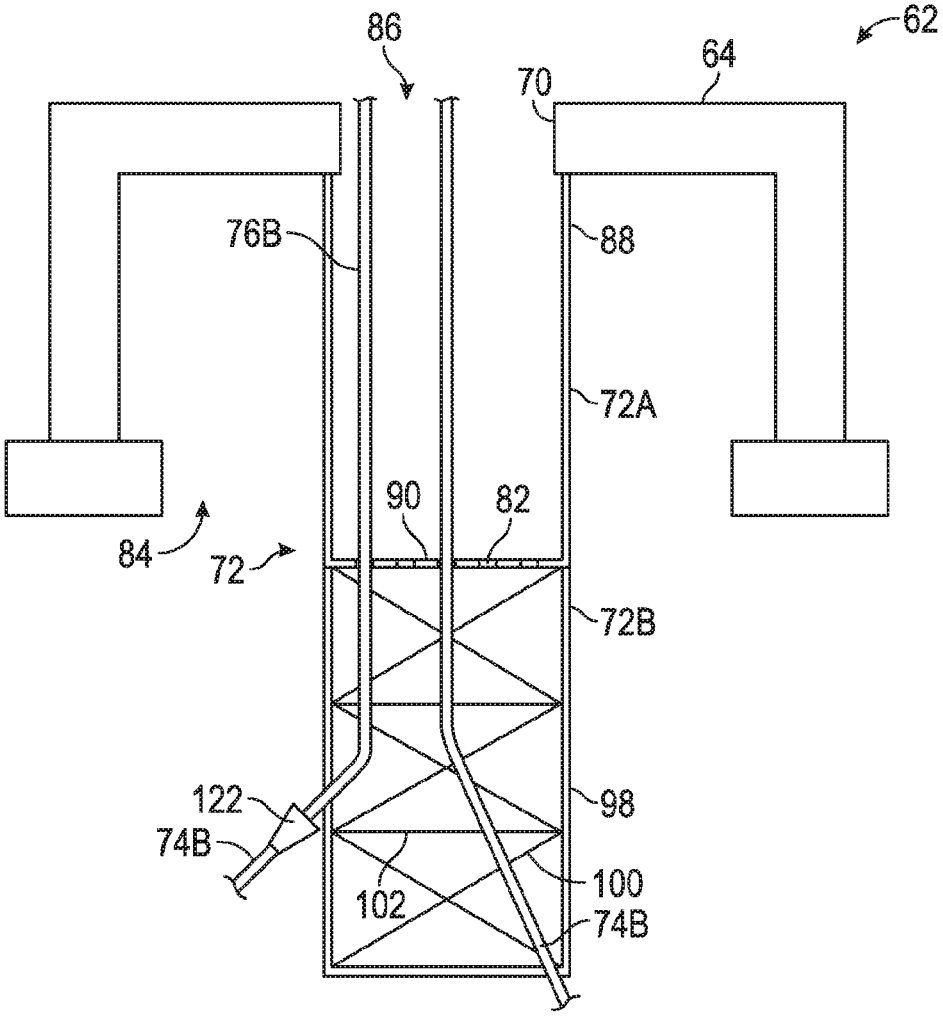
FIG. 6 is a schematic side view of another exemplary embodiment of a converted floating platform.
Figure 7:
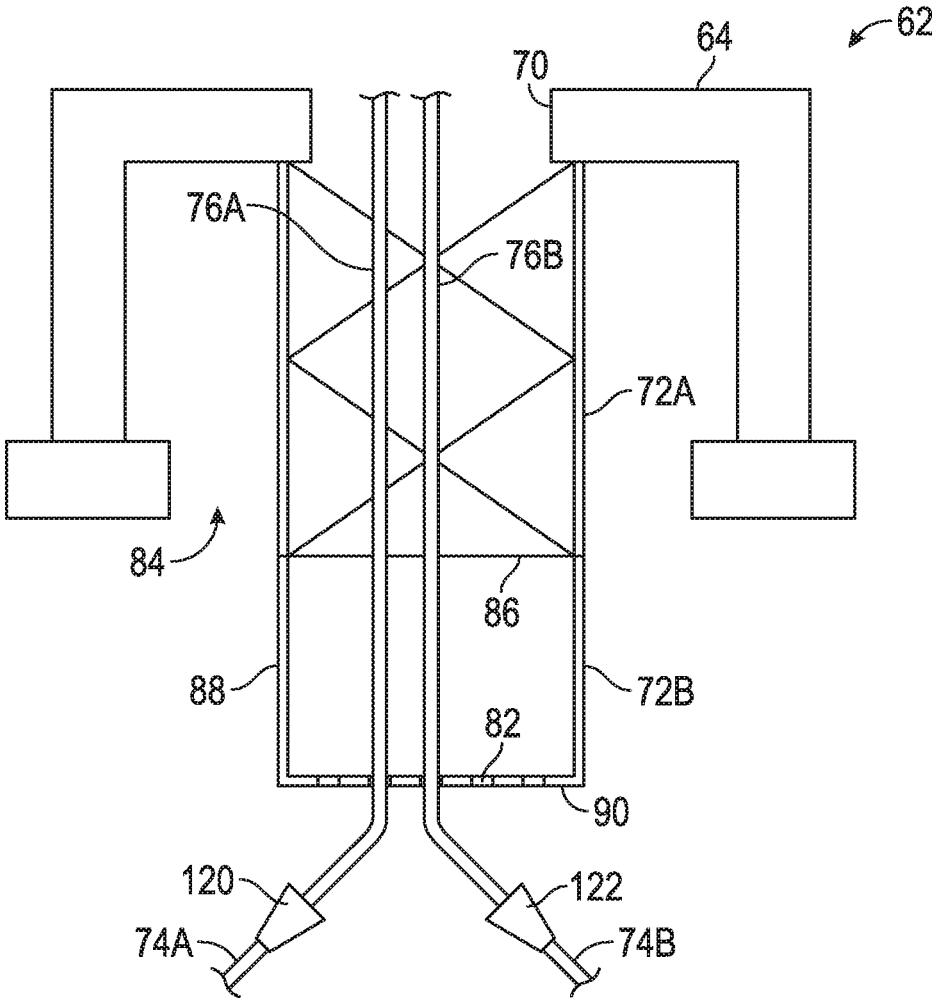
FIG. 7 is a schematic side view of another exemplary embodiment of a converted floating platform.

In at least one embodiment, the risers 74 can be suspended from the platform 62 in a manner to manage the expected heave, roll, and pitch movements of the floating platform. In at least one embodiment, the risers can include a curved portion above the seabed 80 to provide some flexibility for movement. Various embodiments of suspending the risers with additional equipment to manage stress on the risers are shown in FIGS. 5-7 with additional details of the various components provided in FIGS. 15A-15F. The various embodiments for managing stress on the risers illustrated herein can be used with the various embodiments of the riser support module 72 and its portions.

FIG. 5 is a schematic side view of another exemplary embodiment of a converted floating platform. The floating platform 62 includes a topsides 64 supported by columns 66 with buoyancy provided by at least the pontoons 68. The riser support module 72 is coupled to the topsides 64 and extends downward toward the open space 84 of the platform that is below the moonpool 70. In this embodiment, the riser support module 72 is at least partially open to air passing through the top 86 of the riser support module and water passing through the bottom 90 of the riser support module. The bottom 90 can include one or more riser openings to allow the one or more risers to pass therethrough.

This embodiment illustrates one method of increasing dynamic mass to the platform. In this embodiment, the cross-sectional area A2 across the riser support module can be greater than the cross-sectional area A1 across the moonpool 70. Further, sides 88 of the riser support module 72 can form a "shell" around risers disposed therein, and can be resistive to air and/or water movement therethrough, including having substantially solid walls, that are substantially closed to passage of water and/or air therethrough. The sides can be made of metal plates with various shapes to protect the riser and riser equipment from direct wave and current loading, and possible clashing between the risers or the risers and the platform structures. In general, the shell embodiment can protect the risers therein from some of the naturally occurring direct wave and current loading compared to a truss embodiment that has greater transparency to water flow therethrough onto the risers.

Further, a riser 74A can be suspended through a riser pull tube 76A that can be supported through a riser opening 82 on the bottom 90. The riser pull tubes can be used to transition the riser between an inclined orientation below the platform and a nearly vertical orientation at the topsides 64. A bend stiffener 120 can be coupled to the riser and/or riser pull tube to assist the riser in being angled radially outward from the platform toward the sea bed. Another embodiment for the riser pull tube and riser is shown on the right side of FIG. 5. The riser pull tube 76B can extend downward and be coupled with a stress joint 130 generally coupled with the pull tube. The riser 74C can pass through the stress joint 130 and be angled at an inclination.

FIG. 6 is a schematic side view of another exemplary embodiment of a converted floating platform. The floating platform 62 includes an alternative embodiment of the riser support module 72. The riser support module 72 can be coupled to the topsides 64 in line with the moonpool 70. The term "moonpool" is used broadly herein and in general refers to an opening through the topsides sufficient to conduct some or all drilling operations and any other opening of such size that can be formed through the topsides and is aligned with the open space 84. The riser support module includes a first portion 72A as an upper portion and a second portion 72B as a lower portion. The first portion 72A in this embodiment can be formed with at least a partially open top 86 and bottom 90 with substantially closed sides 88. The riser support module 72 can include riser openings 82 generally the bottom 90 to allow the risers (not shown) to pass therethrough. The second portion 72B can be substantially more transparent to the passage of water from side-to-side than the first portion 72A. For example, the second portion 72B can be a truss structure. The truss structure of the second portion 72B can include various braces 100 attached to truss legs 98. To reduce heave movement of the platform, the second portion 72B can include horizontal heave plates 102.

A riser 74B can be assisted with components to help bend between a vertical orientation near the topsides and an inclined position toward the sea bed. For example, in another embodiment on the left side of FIG. 6, the riser 74B can be suspended through a pull tube 76B that can be supported through a riser opening 82 on the bottom 90. A flex joint 122 can be coupled to the riser to assist the riser in being angled radially outward from the platform toward the sea bed. In another embodiment, the riser 74B on the right side of FIG. 6 can gradually bend through the second portion 72B of the riser support module and not use the riser pull tube.

FIG. 7 is a schematic side view of another exemplary embodiment of a converted floating platform. The embodiment in FIG. 7 is similar to the embodiment shown in FIG. 6 with the structures of the first portion 72A and the second 72B reversed. The first portion 72A can be a more transparent to the passage of water from side-to-side, such as a truss structure, than the second portion 72B. The second portion 72B can have a substantially open top 86 and bottom 90 with substantially closed sides 88. The riser openings 82 can be formed through the riser support module 72, generally through the bottom 90.

A riser 74A can be suspended through a riser pull tube 76A that can be supported through a riser opening 82 on the bottom 90. A bend stiffener 120 can be coupled to the riser and/or riser pull tube to assist the riser in being angled radially outward from the platform toward the sea bed. Another embodiment for the riser pull tube and riser is shown on the right side of FIG. 7. The riser pull tube 76B can extend downward and be coupled with a flex joint 122. A flex joint 122 can be coupled to the riser to assist the riser in being angled radially outward from the platform toward the sea bed.

Figure 8A:
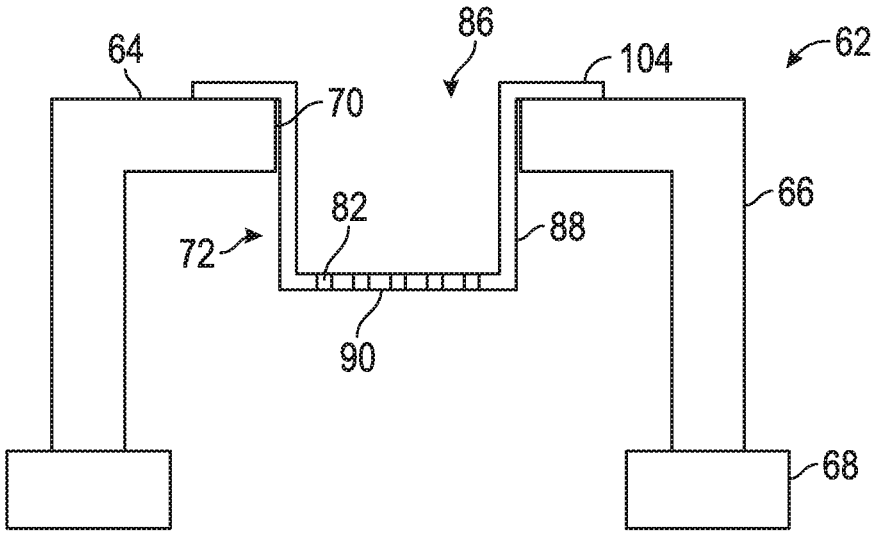
FIG. 8A is a schematic side view of another exemplary embodiment of a converted floating platform.
Figure 8B:
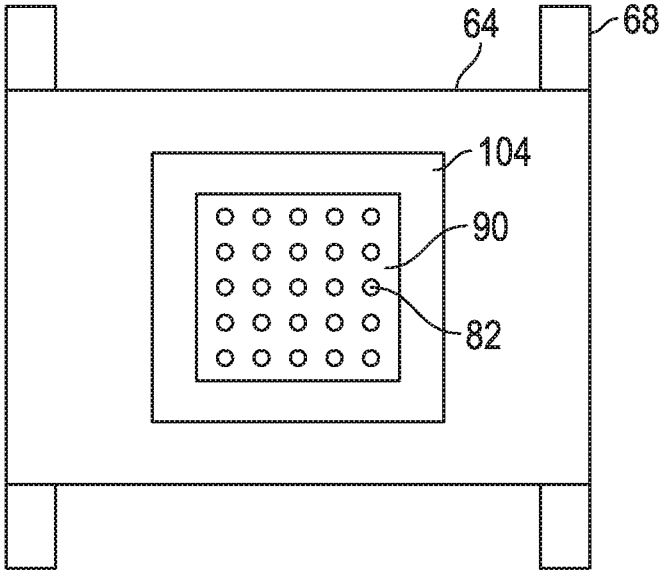
FIG. 8B is a schematic top view of the exemplary converted platform of FIG. 8A.

FIG. 8A is a schematic side view of another exemplary embodiment of a converted floating platform. FIG. 8B is a schematic top view of the exemplary converted platform of FIG. 8A. The riser support module 72 can be coupled to the topsides 64 in a number of ways. For example, the riser support module can be formed with a landing flange or series of landing pads, herein "flange") 104 surrounding the periphery of the riser support module. The riser support module can be inserted through the moonpool 70 of the topsides 64 to rest upon the flange and be fixedly coupled to the platform. The riser support openings 82 can be formed through the riser support module, generally through the bottom 90.

Other embodiments can include the riser support module being coupled to the underside of the topsides 64 such as by welding or other fastening. Other coupling options are contemplated. In each case, the riser support module is fixedly attached to the topsides 64.

In this embodiment and in other embodiments, the peripheral shape of the riser support module 72 can vary. In some cases, the peripheral shape can be round, elliptical, square, rectangular, conical, frustoconical, pyramidal, triangular, prismatic having multiple sides greater than four, and other geometric shapes.

Figure 9A:
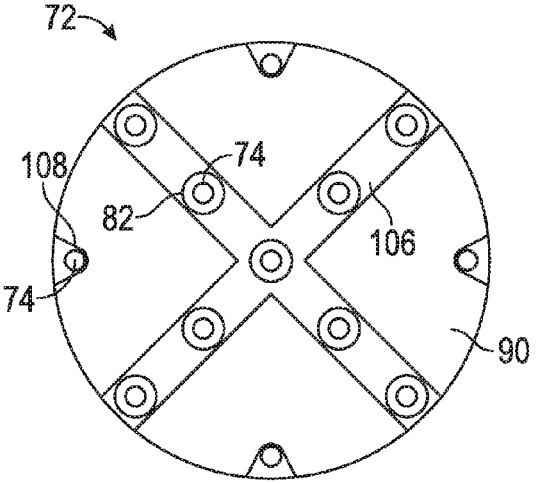
FIG. 9A is a schematic top view of another embodiment of a riser support module.

FIG. 9A is a schematic top view of another embodiment of a riser support module. In this embodiment, the peripheral shape of the riser support module 72 is shown as a circular or elliptical shape. The bottom 90 is substantially open or transparent to flow therethrough. The bottom 90 includes one or more braces 106 across at least a portion of the cross-sectional area. One or more riser openings 82 can be formed through or adjacent to the bracing 106 to support risers 74 passing therethrough. One or more other risers 74 can be supported around a periphery of the riser support module 72 with one or more riser retainers 108 coupled to the riser support module.

Figure 9B:
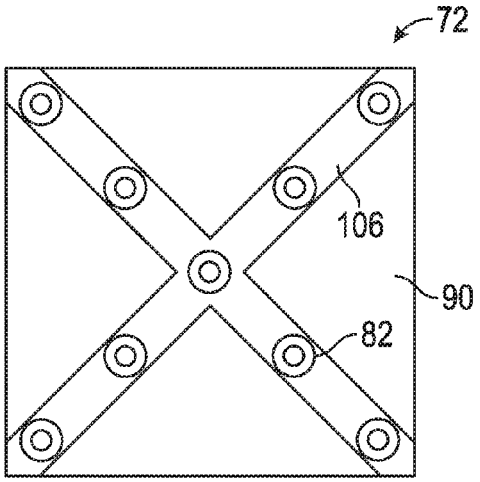
FIG. 9B is a schematic top view of another embodiment of a riser support module.

FIG. 9B is a schematic top view of another embodiment of a riser support module. In this embodiment the peripheral shape of the riser support module 72 is shown as square or rectangular. One or more braces 106 or disposed across at least a portion of the cross-sectional area of the riser support module. One or more riser openings 82 can be formed through or adjacent to the bracing 106. Other risers can be supported around the periphery of the riser support module.

Figure 9C:
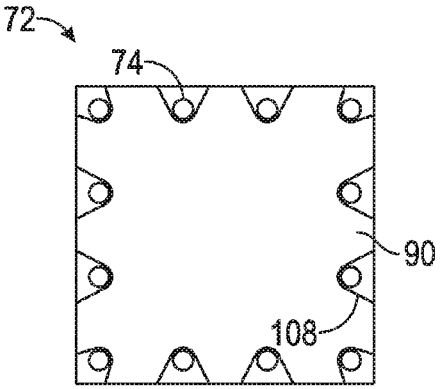
FIG. 9C is a schematic top view of another embodiment of a riser support module.

FIG. 9C is a schematic top view of another embodiment of a riser support module. In this embodiment, the riser support module 72 is similarly shaped square or rectangular (although the shape can vary), but the riser support module does not include cross-sectional bracing. Rather, one or more riser retainers 108 can support one or more risers 74 and can be coupled around a periphery of the riser support module 72.

Figure 9D:
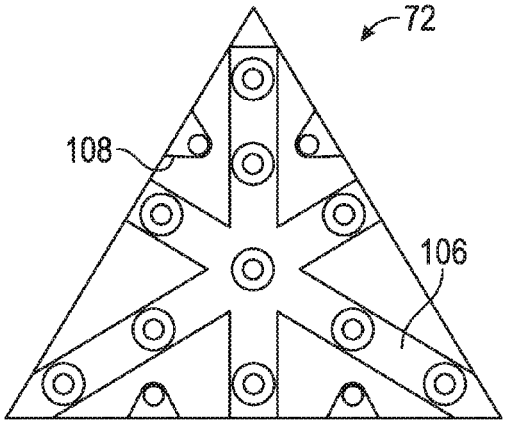
FIG. 9D is a schematic top view of another embodiment of a riser support module.

FIG. 9D is a schematic top view of another embodiment of a riser support module. In this embodiment, the riser support module 72 is triangularly-shaped. One or more braces 106 can be formed across the cross-sectional portions of the riser support module. One or more riser openings 82 can be formed through or adjacent to the bracing. Further, one or more retainers 108 can be formed around the periphery of the riser support module 72.

Figure 10:
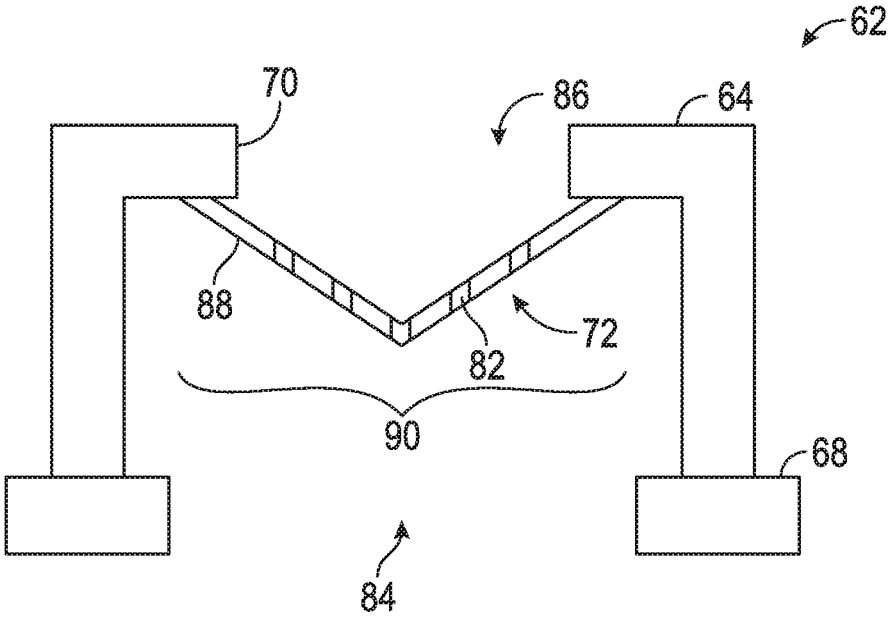
FIG. 10 is a schematic side view of another exemplary embodiment of a converted floating platform.

FIG. 10 is a schematic side view of another exemplary embodiment of a converted floating platform. In this embodiment, the riser support module 72 is shown as a conical shape with a larger portion at the top 86 that can be coupled to the topsides 64. The sides 88 of the conical shape converge substantially at the bottom 90. One or more riser openings 82 can be formed through the sides 88 so that risers can pass through the riser support module and through the open space 84 of the platform.

Figure 11:
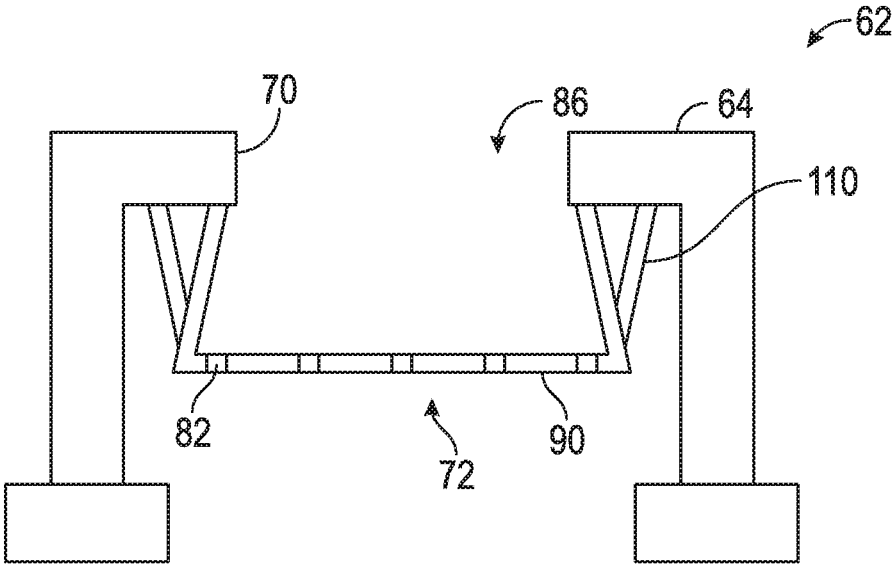
FIG. 11 is a schematic side view of another exemplary embodiment of a converted floating platform.

FIG. 11 is a schematic side view of another exemplary embodiment of a converted floating platform. In this environment, the riser support module 72 can have a smaller top 86 than the bottom 90, and be coupled to the topsides 64. One or more riser openings 82 can be formed in the riser support module 72, generally at the bottom 90. One or more braces 110 can help couple the riser support module to the topsides.

Figure 12A:
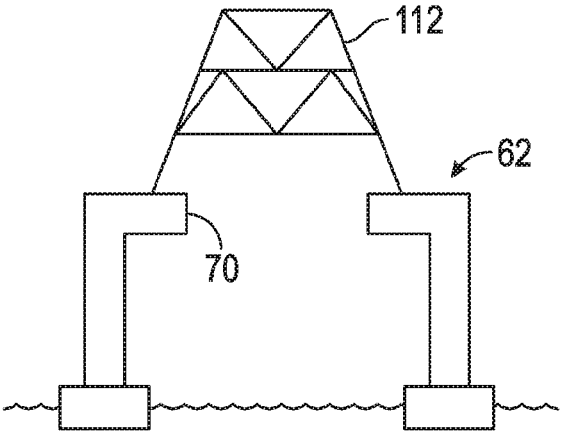
FIG. 12A is an schematic side view on an exemplary drilling platform preparing for conversion to an exemplary production platform.
Figure 12B:
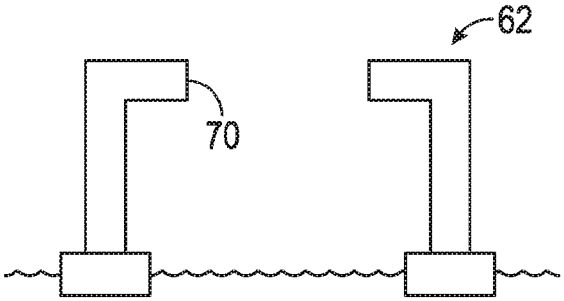
FIG. 12B is an schematic side view of the drilling platform of FIG. 12A with a derrick relocated from a moonpool.
Figure 12C:
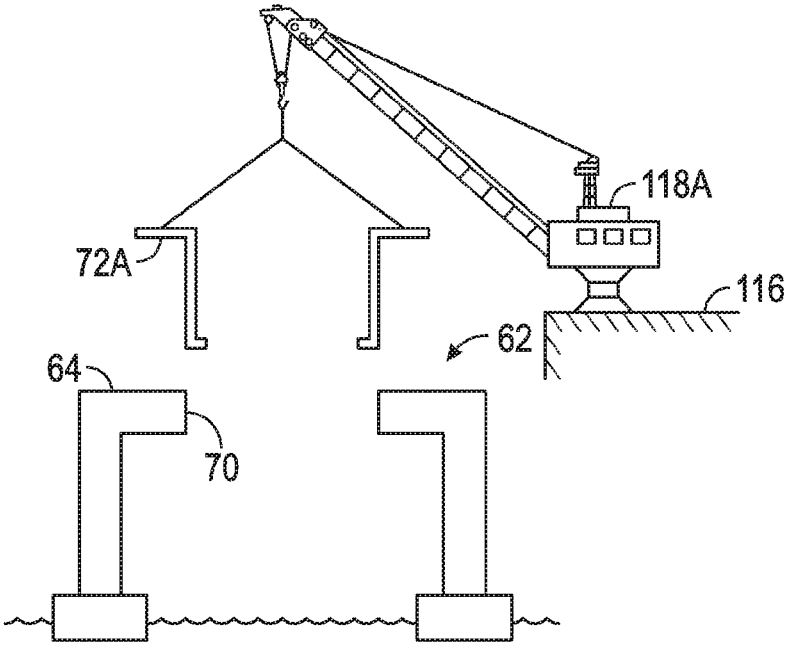
FIG. 12C is an schematic side view of the drilling platform of FIG. 12A with a portion of a riser support module suspended over the moonpool.
Figure 12D:
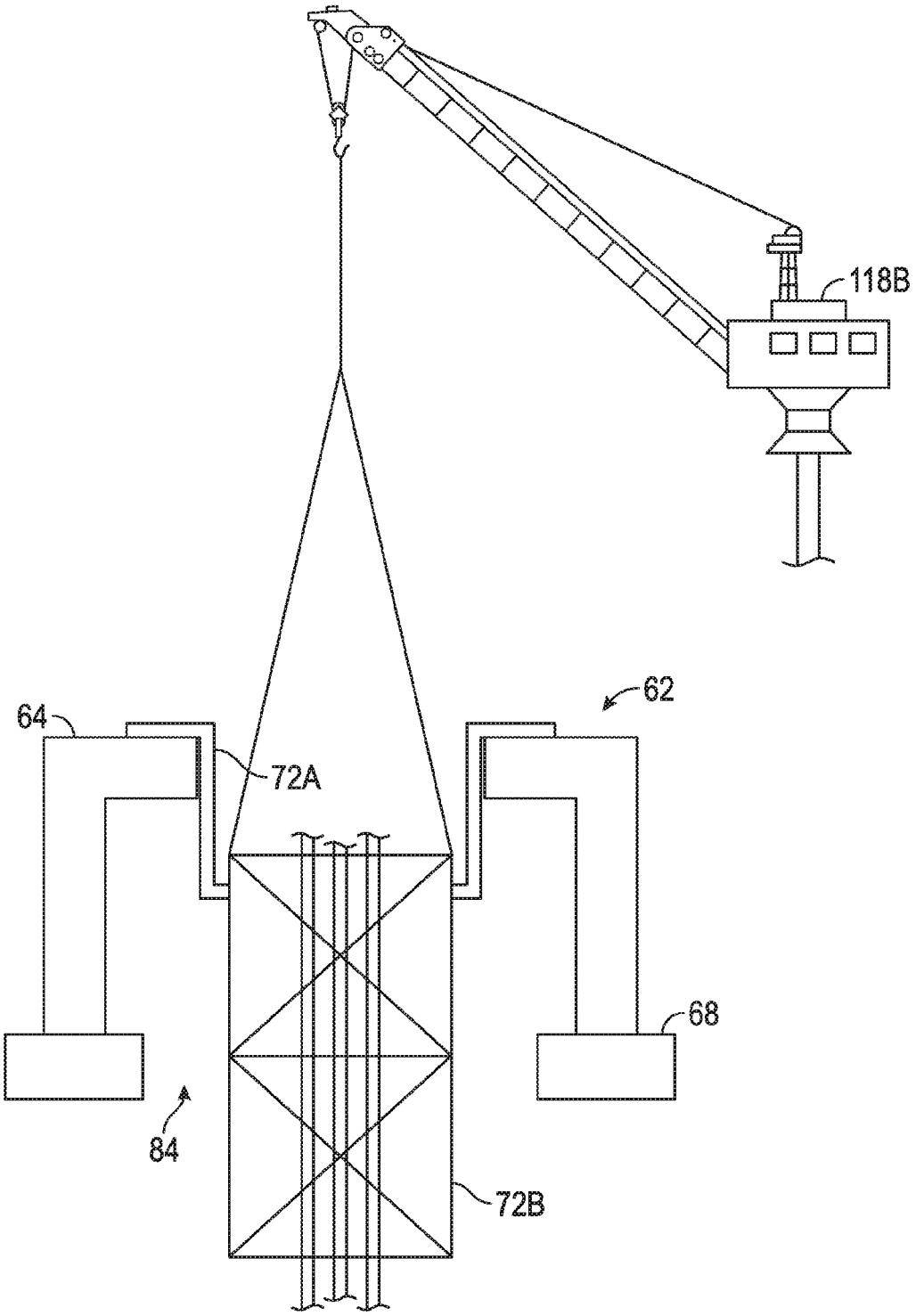
FIG. 12D is an schematic side view of the drilling platform of FIG. 12A with the portion of the riser support module coupled to the topsides at the moonpool and a further portion of the riser support module being installed.

FIG. 12A is an schematic side view on an exemplary drilling platform preparing for conversion to an exemplary production platform. FIG. 12B is an schematic side view of the drilling platform of FIG. 12A with a derrick relocated from a moonpool. FIG. 12C is an schematic side view of the drilling platform of FIG. 12A with a portion of a riser support module suspended over the moonpool. FIG. 12D is an schematic side view of the drilling platform of FIG. 12A with the portion of the riser support module coupled to the topsides at the moonpool and a further portion of the riser support module being installed. The production floating platform 62 is configured for drilling operations with a derrick 112 and a moonpool 70. For conversion, the derrick 112 can be moved away from the moonpool 70 to provide access for the riser support module. The riser support module can be suspended over the moonpool 70 and lowered into position through the moonpool. For example, if operations are performed at a quayside 116, a local crane 118A can be used to lift a first portion 72A of the riser support module above the moonpool 70 and lower the first portion into the moonpool for coupling to the topsides 64. A second portion 72B can also be lowered through the first portion 72A in a similar manner to be coupled therewith. As one example, the first portion 72A could be installed and coupled with the topsides at the quayside, while the second portion 72B could be lowered through the first portion and coupled therewith at an offshore location. The riser support module can extend in some embodiments through the open space 84 between the pontoons 68 of the floating platform. The riser support module 72 can support risers and other production equipment required such as riser pulled tubes, which can be straight or curved, and the like for a production platform.

The embodiment shown in FIGS. 12A-12D is similar to the embodiment described in FIG. 6 for the riser support module when combined with the embodiment described in FIG. 8A-8B with the riser support module having a flange 104. The sequence described in these Figures is illustrative of various combinations that are not specifically disclosed among the many embodiments but that are contemplated by those with ordinary skill in the art given the teachings herein. Thus, the sequence and the embodiments shown and described are not exclusive but are only exemplary as representative embodiments. In other embodiments, the riser support module could be floated on a barge or other vessel and placed into position from under the moonpool for attachment to the topsides. Alternatively, a crane could be attached to a riser support module located below the moonpool and lift the module through the moonpool into position for coupling with the topsides. Thus, the riser support module does not need to pass through the moonpool for installation and coupling with the topsides. Further, the first portion and second portion of the riser support module illustrated in FIG. 12D can be attached prior to an insertion through the moonpool, depending on the height required to lift the assembled riser support module above the moonpool. Still further, the first portion 72A can be attached in the manner shown, and the second portion 72B can be attached by other manners, such as being attached to the first portion from below the first portion instead of through the first portion. Other combinations are contemplated.

Figure 13:
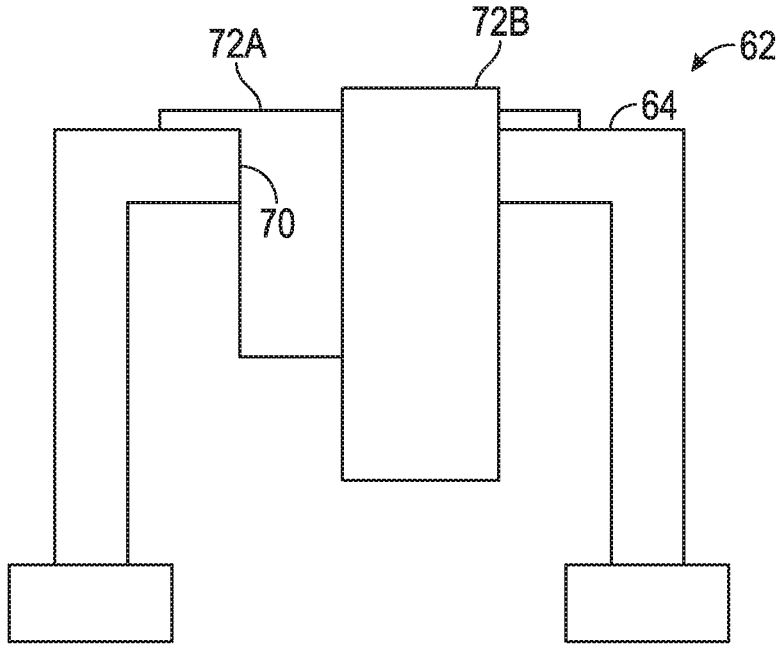
FIG. 13 is a schematic side view of another exemplary embodiment of a converted floating platform.

FIG. 13 is a schematic side view of another exemplary embodiment of a converted floating platform. In this embodiment, the riser support module can be formed in lateral portions as well. For example, a first portion 72A can include a shorter specific purpose portion that differs from a longer second portion 72B design for a second purpose.

Figure 14:
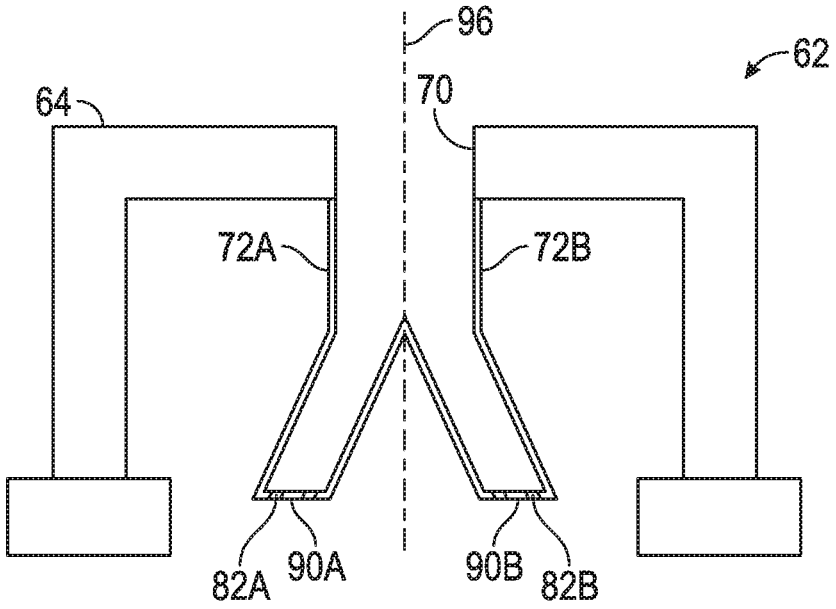
FIG. 14 is a schematic side view of another exemplary embodiment of a converted floating platform.

FIG. 14 is a schematic side view of another exemplary embodiment of a converted floating platform. In this embodiment, the riser support module can be formed from a first portion 72A that is disposed at an angle relative to a vertical line 96 passing through the moonpool 70. Similarly, a second portion 72B can be disposed at an angle relative to the vertical line 96 that is different than the angle of the first portion 72A. The riser support module portions 72A and 72B can have riser openings 82A and 82B, respectively, such as through bottoms 90A and 90B. The angles can facilitate aligning the risers passing through the riser support module in a manner to compartmentalize the risers extending from the platform 62.

Figure 15A:
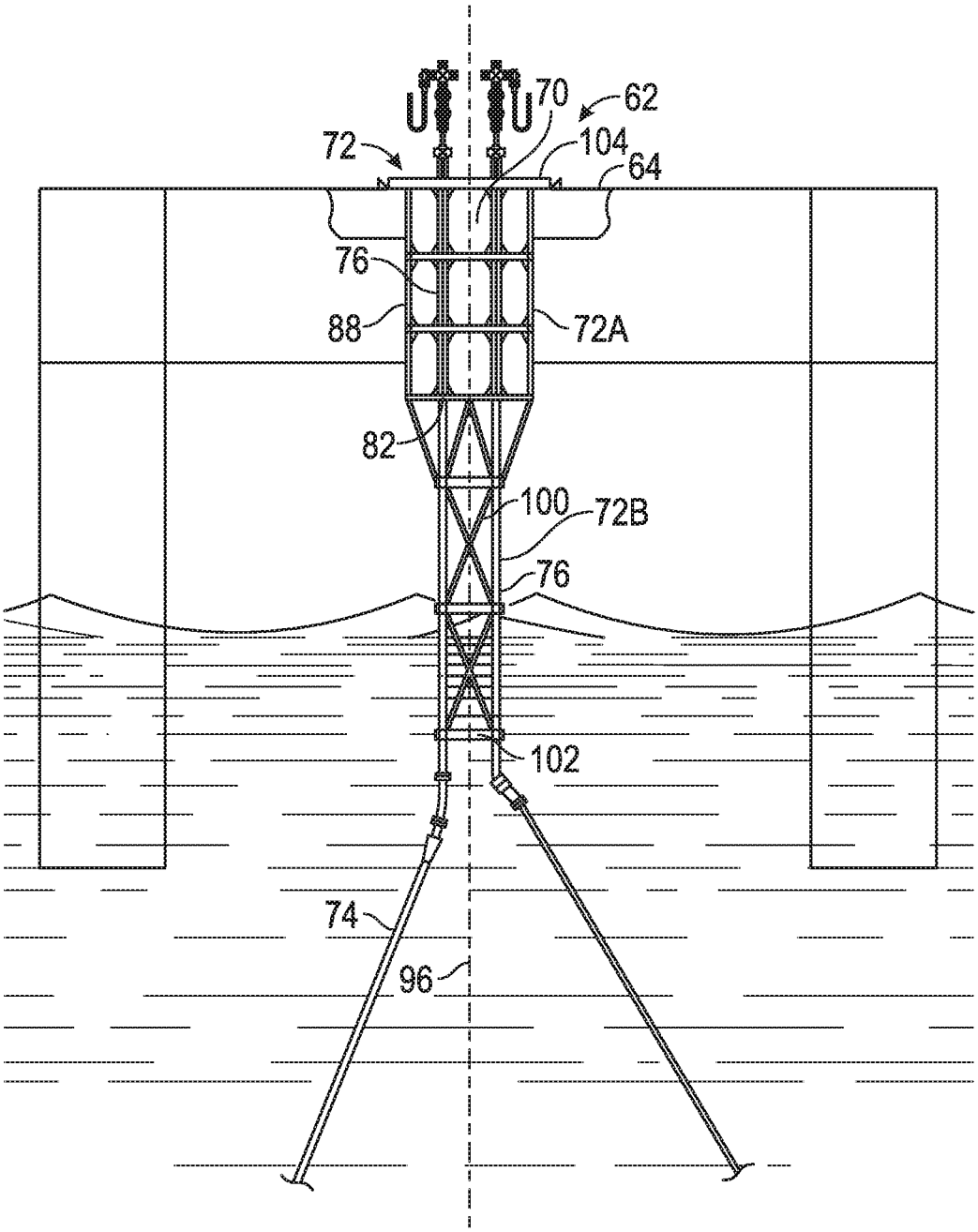
FIG. 15A is a schematic partial side view of another exemplary embodiment of a converted floating platform with a riser support module coupled to a topsides of the platform.
Figure 15B:
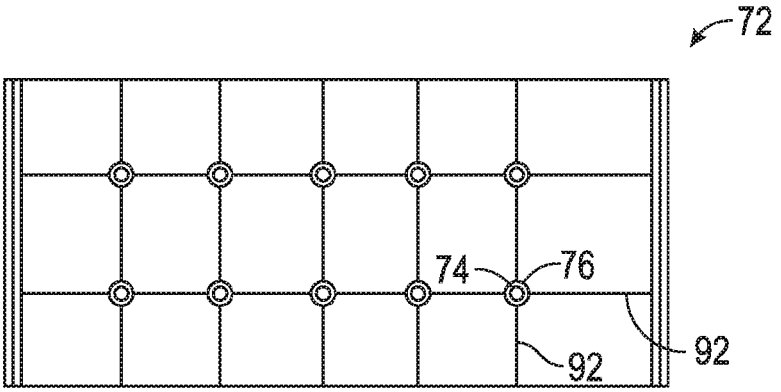
FIG. 15B is a schematic top view of an exemplary riser support module of FIG. 15A.
Figure 15C:
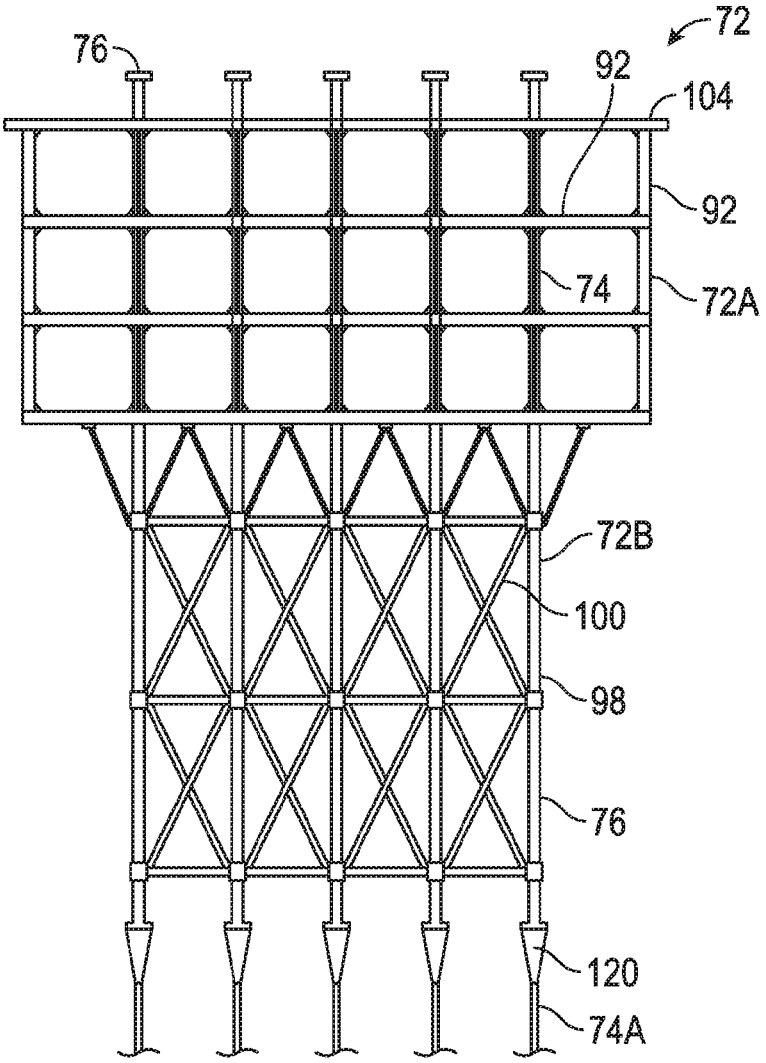
FIG. 15C is a schematic front view of the riser support module of FIG. 15A.
Figure 15D:
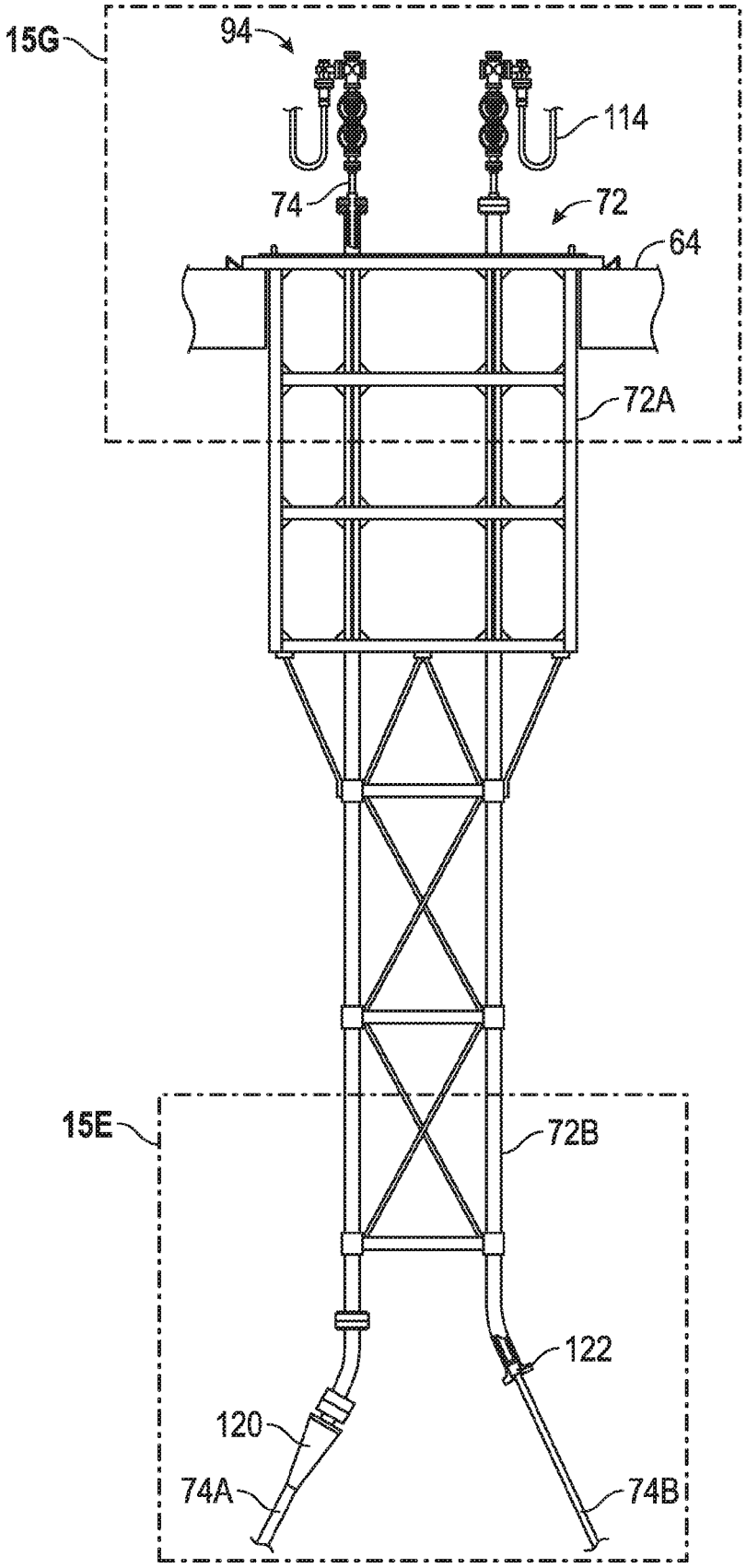
FIG. 15D is a schematic enlarged partial side view of the platform topsides and riser support module of FIG. 15A.
Figure 15E:
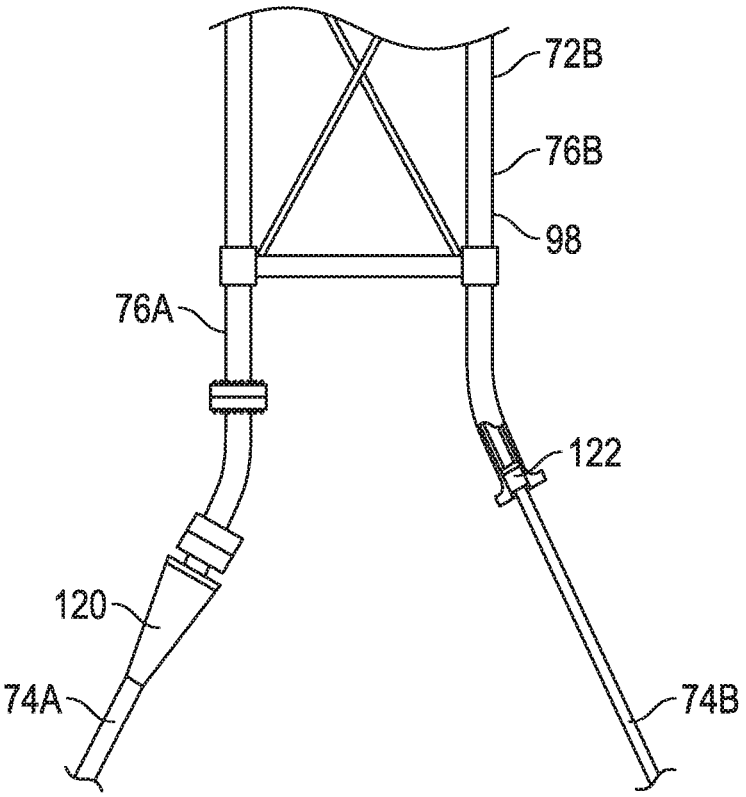
FIG. 15E is a schematic enlarged partial side view of a lower portion of the riser support module.
Figure 15F:
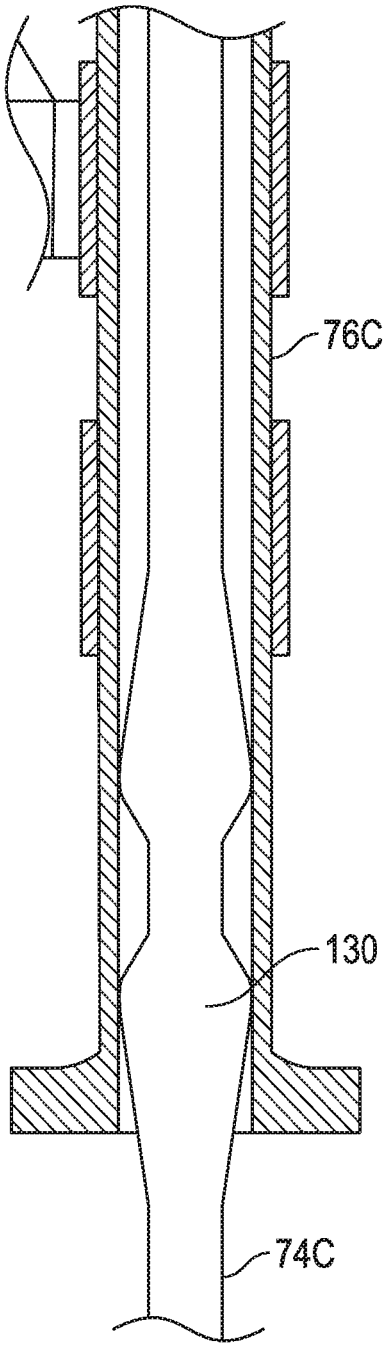
FIG. 15F is a schematic enlarged partial cross sectional view of an alternative riser tube assembly.
Figure 15G:
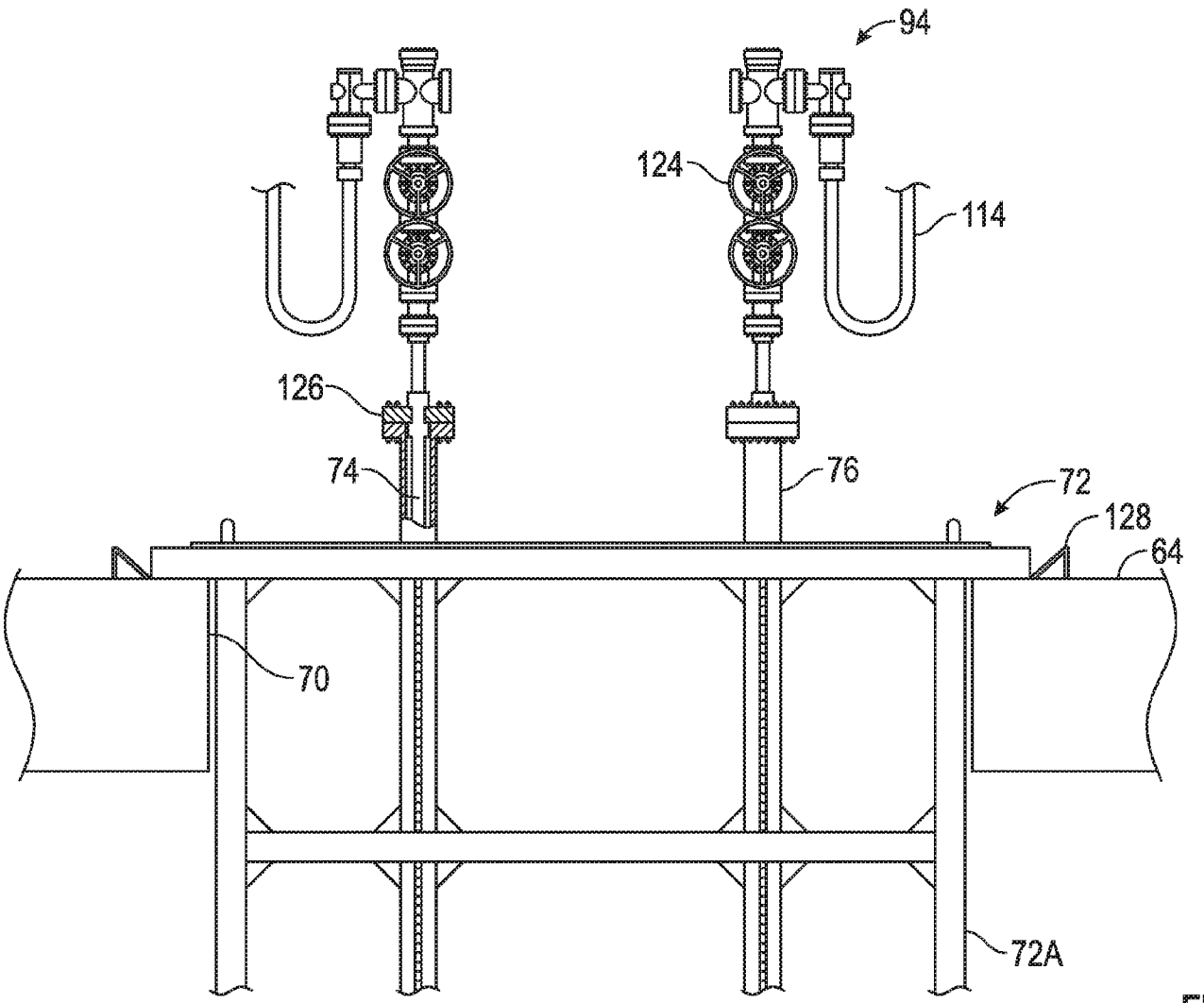
FIG. 15G is a schematic enlarged partial side view of an upper portion of the riser support module.

FIG. 15A is a schematic partial side view of another exemplary embodiment of a converted floating platform with a riser support module coupled to a topsides of the platform. FIG. 15B is a schematic top view of an exemplary riser support module of FIG. 15A. FIG. 15C is a schematic front view of the riser support module of FIG. 15A. FIG. 15D is a schematic enlarged partial side view of the platform topsides and riser support module of FIG. 15A. FIG. 15E is a schematic enlarged partial side view of a lower portion of the riser support module. FIG. 15F is a schematic enlarged partial cross sectional view of an alternative riser tube assembly. FIG. 15G is a schematic enlarged partial side view of an upper portion of the riser support module. FIGS. 15A-15G provide additional details for the floating platform conversion, such as riser pull tubes, valving, transition elements for risers, and other equipment, that can be applied to other embodiments described herein.

The topsides 64 of the platform 62 can have a riser support module 72 coupled thereto. In this exemplary embodiment, the riser support module can be coupled to the topsides with a flange 104 assisting in the coupling, although other methods and embodiments are contemplated. The riser support module 72 can include a first portion 72A and a second portion 72B. The first portion 72A can include structural elements to support one or more riser pull tubes or guide tube 76. By extending the riser pull tubes to an elevation below the topsides, including below the pontoons as described in some embodiments, the wave zone forces are reduced on the riser. Instead, the wave forces are applied to the riser pull tubes and reduce the severity of the effect of the platform motions on the risers. The riser pull tubes 76 can form part of the structural elements of the first portion. Thus, the riser pull tubes can be integrated with the structural supports for the first portion. The sides 88 can be open to side-to-side movement of water therethrough. The combined structure of elements for the first portion 72A can form a strong composite "beam" for supporting the riser vertical loads and their induced bending loads across the moonpool span.

The second portion 72B can be coupled to the first portion 72A and can be a truss-like structure. The second portion 72B can extend the riser pull tubes 76 of the first portion 72A. The riser pull tubes 76 can form a portion of the truss structure of the second portion 72B as columns for the truss structure of the second portion 72B. Various braces 100 can be coupled to the riser pull tubes 76 to further form the truss structures. Optional heave plates 102 can be coupled to the lower portion 72B.

The riser support module 72 can form a structural grid of riser pull tubes 76 through which the risers 74 can extend, as shown for example in the top view of FIG. 15B. The grid spacing can correspond to accommodate surface valves located above the riser support module and to reduce riser-to-riser interference below the floating platform. Other structural members 92 can support the riser pull tubes 76 in position.

One or more risers 74 can extend through the riser pull tubes 76 of the riser support module 72 from above the topsides 64 in the module 72. The top of the risers can be coupled to valving and other production equipment, as shown in FIG. 15G. For example, the risers can be coupled with a riser surface support 126, such as a collar, to assist in suspending the riser 74 in the riser pull tube 76 of the riser support module 72. Valves 124 and associated equipment can direct and control flow through the riser. Tubing including conduits and pipes, can couple the valving to downstream production equipment (not shown). One or more tubing jumper loops 114 can be formed to assist in movement of the riser 74 relative to the downstream production equipment. Also, as shown in FIG. 15B, a landing guide 128 coupled to the topsides can be used to assist in placement of the riser support module 72 into the opening of the moonpool 70.

The riser 74 can also extend below the riser support module. In some embodiments, such as the one illustrated, the risers can be inclined relative to a vertical line 96. At the lower end of the second portion 72B, various transition elements can be coupled to the riser pull tubes. The transition elements can help mitigate stress on the riser caused by the motion of the floating platform. In one embodiment, a bend stiffener 120 can transition from the riser pull tube 76A to the riser 74A. The bend stiffener 120, for example, might be used when the riser 74A is a flexible riser or an umbilical or flexible jumper for a freestanding hybrid riser, known in the art. In another embodiment, a flexible joint 122 can transition from the riser pull tube 76B to the riser 74B. The flexible joint 122, for example, might be used when the riser 74B is a steel riser. In yet another example, shown in FIG. 15F, a stress joint 130 can transition from the riser pull tube 76C to the riser 74C. The stress joint can have a single or double (other other) points of contact with the riser pull tube, known in the art as "single bump" or "double bump" designs, where the double bump design is illustrated without limitation. The stress joint 130, for example, might be used when the riser 74C is a steel riser.

Other and further embodiments utilizing one or more aspects of the invention described above can be devised without departing from the spirit of Applicant's invention. For example, various combinations of the embodiments and other embodiments can be made, various relative sizes of the riser support module and any portions thereof can vary, the number of portions of the riser support module can vary, the number and placement of risers and/or riser pull tubes can vary, the manner of supporting the risers can vary, the manner of coupling of the riser support module with the topsides can vary, and other variations can occur in keeping within the scope of the claims.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalents of the following claims.

What is claimed is:

1. A system of conversion of an offshore floating platform for hydrocarbon production, comprising:

a drilling offshore floating platform comprising:

a topsides having a drilling moonpool formed therethrough and configured for drilling a well;

at least three columns coupled to the topsides, the columns extending above a water level and below the water level during operations; and at least two pontoons coupled to the columns, the pontoons having buoyancy and extending at least partially below the water level; and a riser support module suspended below the drilling moonpool of the topsides and fixedly coupled to the topsides, the module being a non-water tight truss and configured to support at least one riser that extends through the drilling moonpool and the riser support module to convert the drilling offshore floating platform without the riser support module to a production offshore floating platform having the riser support module using the same drilling moonpool, wherein a structural column of the truss forms a riser pull tube, the riser pull tube configured to allow the at least one riser to pass therethrough.

2. The system of claim 1, wherein at least a portion of the riser support module forms a peripheral shell around the at least one riser when at least partially disposed in the shell.

3. The system of claim 1, wherein at least a portion of the riser support module forms a truss.

4. The system of claim 1, wherein at least a portion of the riser support module forms a peripheral shell around the at least one riser during production operations when deployed, and another portion forms a truss.

5. The system of claim 4, wherein the peripheral shell portion is coupled to the topsides, and the truss portion is coupled below the shell portion.

6. The system of claim 4, wherein the truss portion is coupled to the topsides, and the shell portion is coupled below the truss portion.

7. The system of claim 1, further comprising at least one riser pull tube coupled to the riser support module, the riser pull tube configured to allow a riser to pass therethrough.

8. The system of claim 1, wherein a cross sectional area across the riser support module is greater than a cross sectional area across the moonpool.

9. The system of claim 1, wherein the riser support module further comprises a flange and wherein the riser support module is sized to be inserted through the moonpool and support the module with the flange on the topsides.

10. The system of claim 1, wherein the riser support module comprises riser openings, riser retainers, or a combination thereof.

11. The system of claim 1, wherein the riser support module comprises a first portion and a second portion, each having a bottom and wherein the bottoms are directed at an angle to a vertical line passing through the floating platform.

12. The system of claim 1, further comprising a plurality of risers supported with the riser support module and wherein the risers below the riser support module are directed at an angle to a vertical line passing through the floating platform.

13. The system of claim 1, further comprising a riser pull tube coupled to the riser support module and wherein the riser pull tube is coupled with a bend stiffener, flex joint, or stress joint which is coupled to the riser that extends below the riser support module.

14. A method of converting an offshore floating platform for hydrocarbon production, comprising:

accessing a drilling offshore floating platform having a topsides with a drilling moonpool formed therethrough and configured for drilling a well; at least three columns coupled to the topsides, the columns extending above a water level and below the water level during operations; and at least two pontoons coupled to the columns, the pontoons having buoyancy and extending at least partially below the water level; and fixedly coupling a riser support module to the topsides to suspend below the drilling moonpool, the module being a non-water tight truss and configured to support at least one riser that extends through the drilling moonpool and the riser support module to convert the drilling offshore floating platform without the riser support module to a production offshore floating platform with the riser support module using the same drilling moonpool, wherein a structural column of the truss forms a riser pull tube, the riser pull tube configured to allow the at least one riser to pass therethrough.

15. The method of claim 14, further comprising preassembling the riser support module;

lifting the riser support module above the moonpool;

lowering the riser support module through the moonpool; and fixedly coupling the riser support module to the topsides.

16. The method of claim 14, further comprising preassembling the riser support module;

lifting the riser support module from below the moonpool to an underneath portion of the topsides;

aligning the riser support module with the moonpool; and fixedly coupling the riser support module to the topsides.

17. A system for hydrocarbon production, comprising:

a drilling offshore floating platform comprising:

a topsides having a drilling moonpool formed therethrough and configured for drilling a well;

at least three columns coupled to the topsides, the columns extending above a water level and below the water level during operations; and at least two pontoons coupled to the columns, the pontoons having buoyancy and extending at least partially below the water level; and a riser support module suspended below the drilling moonpool of the topsides and fixedly coupled to the topsides, the module being a non-water tight truss and configured to support at least one riser that extends through the drilling moonpool and the riser support module to convert the drilling offshore floating platform without the riser support module to a production offshore floating platform with the riser support module using the same drilling moonpool, wherein a structural column of the truss forms a riser pull tube, the riser pull tube configured to allow the at least one riser to pass therethrough.

* * * * *